US005775946A

United States Patent [19]

Briones

[11] Patent Number: 5,775,946

[45] Date of Patent: Jul. 7, 1998

[54] SHIELDED MULTI-PORT CONNECTOR AND METHOD OF ASSEMBLY

[75] Inventor: Francisco R. Briones, Markham, Canada

[73] Assignee: Amphenol Corporation, Wallingford, Conn.

[21] Appl. No.: 702,179

[22] Filed: Aug. 23, 1996

[51] Int. Cl.[6] ..... H01R 13/648

[52] U.S. Cl. ..... 439/607; 439/676

[58] Field of Search ..... 439/607–610, 439/95, 108, 676

[56] References Cited

U.S. PATENT DOCUMENTS

| | | | |
|---|---|---|---|
| 4,537,459 | 8/1985 | Brennen et al. | 339/143 |
| 4,678,121 | 7/1987 | Douty et al. | 439/610 |
| 4,679,879 | 7/1987 | Triner et al. | 439/425 |
| 4,695,115 | 9/1987 | Talend | 439/76 |
| 4,838,811 | 6/1989 | Nakamura et al. | 439/607 |
| 4,842,555 | 6/1989 | Cosmos et al. | 439/609 |
| 4,878,858 | 11/1989 | Dechelette | 439/607 |
| 4,978,317 | 12/1990 | Pocrass | 439/490 |
| 4,986,779 | 1/1991 | Ferrill et al. | 439/108 |
| 5,017,156 | 5/1991 | Sugiyama | 439/607 |
| 5,030,140 | 7/1991 | Sugiyama | 439/607 |
| 5,083,945 | 1/1992 | Miskin et al. | 439/607 |
| 5,087,210 | 2/1992 | Myers et al. | 439/425 |
| 5,195,911 | 3/1993 | Murphy | 439/607 |
| 5,207,597 | 5/1993 | Kline et al. | 439/607 |
| 5,281,169 | 1/1994 | Kiat et al. | 439/607 |
| 5,378,172 | 1/1995 | Roberts | 439/607 |
| 5,397,520 | 3/1995 | Rohrbach et al. | 264/122 |
| 5,417,590 | 5/1995 | Dechelette et al. | 439/607 |
| 5,496,195 | 3/1996 | Reed | 439/607 |
| 5,613,879 | 3/1997 | Fonteneau et al. | 439/607 |
| 5,639,267 | 6/1997 | Loudermilk | 439/607 |

*Primary Examiner*—Hein Vu
*Attorney, Agent, or Firm*—Bacon & Thomas, PLLC

[57] ABSTRACT

An RJ-type electrical connector includes a one-piece stamped and formed shield having a top panel for covering a top wall of a housing of the connector, side panels for covering the opposite sides of the housing, a front panel for covering a front of the housing about a plug opening, and a rear panel for covering a rear of the housing, the bottom of the front panel including a transverse extension which fits under the front portion of the connector housing after fitting of the shield on the housing and before securing the shield to the housing, and the rear panel of the shield including a forwardly extending tab supporting an upwardly extending latch, the latch cooperating with a cavity on the lower side of the connector to secure the shield to the connector when the rear panel of the shield is folded over the rear of the connector to complete assembly of the shield to the connector. The connector can be a multi-port connector, in which case a plurality of engaging of latches and cavities are distributed along the width of the connector adjacent the rear wall.

32 Claims, 7 Drawing Sheets

SHIELDED MULTI-PORT CONNECTOR AND METHOD OF ASSEMBLY

BACKGROUND OF THE INVENTION

1. Field of the Invention

This invention relates to the field of electrical connectors, and in particular to a shielded multi-port connector, a one-piece shield for a shielded multi-port connector, and a method of assembling a shield to a shielded multi-port connector.

2. Discussion of Related Art

Shielded electrical connector systems are used widely in high speed digital communications and data transfer networks. The use of shielding prevents emission of radiation during data transfers and protects system electronics from external radio frequency sources.

A common type of shielded electrical connector system used for high speed digital communications is the "RJ" or telephone jack-type connector. This type of connector, which resembles the modular jack connector used for telephones, has the advantages of small size, ease-of-use, and low cost resulting from its simple construction. In its simplest form, a shielded RJ connector is made up of electrical contacts, a molded plastic shell or housing for the contacts, and the shielding, which typically consists of a stamped and formed member arranged to be folded so as to fit over the outside of the plastic shell. In addition the standard shielded RJ connector, can include optional element such as filters, transformers, spark gaps, and indicator lights, as disclosed for example in U.S. Pat. No. 5,397,250.

Because of its wide applicability and simple low cost construction, the standard RJ connector is essentially a mass-produced commodity item, the stamped and formed metal shields contributing significantly to the total cost of manufacturing the connectors. As a result, even the smallest improvement in manufacturability or ease-of-assembly can result in significant cost savings to the manufacturer, and a large amount of attention has been devoted to problems of optimizing manufacture and assembly of shielded RJ connectors, resulting in at least two patents specifically directed to this problem. These two patents are U.S. Pat. Nos. 5,083,945 (Miskin et. al.) and 5,378,172 (Roberts).

The basic premise of both the Miskin and Roberts shielding arrangements is to form the shield in one piece which is folded to fit over the molded connector shell, with the rear portion of the shield being folded into place after fitting over the shell and secured by interengaging detents or a tab and slot arrangement on the side and rear walls of the housing. This has the advantage of facilitating assembly of the shield to the connector and is also said to rigidify the shielding, but also creates at least two problems.

The first problem is that, because the shielding in the Miskin and Roberts designs is completed by the step of securing the folded-over rear panel of the shield to the side panel of the shield, as opposed to securing the folded-over rear panel of the shield directly to the housing, additional measures are necessary to secure the shield to the housing, which may appear to be a trivial disadvantage for a single connector, but becomes highly significant with respect to mass production.

In the Roberts patent, for example, a tab 62 extends downwardly from the side of the shielding and must be bent upwardly to form a hook which snaps onto a recess in the side of the housing as the shield is placed over the connector, with the front being secured by a housing engaging tab 90.

In the Miskin et. al. arrangement, a detent tab 46 is cut out of the side of the shielding and snapped into a recess 48 in the side of the housing as the shield is fitted over the housing with a housing engaging tab 60. The combination of a front tab which extends inwardly from the front of the housing and a detent or hook extending from the side of the housing complicates assembly of the shield to the housing because the detent in both the Miskin and Roberts arrangements must be moved downwardly into the corresponding recess while the front tabs requirement rearward movement of the shield relative to the housing, or the front tabs must be bent into place after assembly. As a result, the shield in these designs must be moved in two directions in order to be secured to the housing, with little tolerance, or an extra assembly step is required.

The present invention eliminates the problem of separate securing of the folded-over rear panel of the shield to the side panel of the shield, and of the shield to the housing, by enabling the shielding to be secured to the housing at the same time that the rear panel of the shield is bent into position, with no need for side panel hooks or detents.

The second problem with the Miskin and Roberts designs is that, because the shielding is secured to the housing only at the sides, it is unsuitable for multi-port connectors in which the housing encompasses a plurality of plug openings, because the length of the connector is left completely unsecured.

SUMMARY OF THE INVENTION

It is accordingly an objective the invention to provide a shielded electrical connector having a one-piece shield of the type in which the rear panel of the shield remains parallel to the top of the connector as the shield is fitted over the connector, as in prior designs, but in which the shield is secured to the connector simultaneously with folding of the rear panel of the shield into position at the back of the connector, rather than separately.

It is a further objective of the invention to provide a shielded multi-port electrical connector having a one-piece shield secured to the connector at the front and rear of the connector rather than at the sides.

It is yet another objective of the invention to provide a shield for a multi-port RJ connector which is secured to the connector housing after placement of the shield in position on the housing and folding of the rear panel of the shield into place at the rear of the connector housing, and which secures the shield to the housing at the front and rear of the connector housing.

It a corollary objective of the invention to provide a shield for an electrical connector such as an RJ connector, which is arranged to be secured to the connector housing and upon folding of the rear panel of the shield into place at the rear of the connector housing, and which is secured from both the front and rear of the connector.

It is also an objective of the invention to provide a method of assembling a shield to a connector housing, the shield being a one piece shield of the type in which the rear panel of the shield is remains parallel to the top of the connector as the shield is fitted over the connector, and in which the shield is secured to the connector simultaneous with folding of the rear panel of the shield into position at the back of the connector.

It is yet another objective of the invention to provide a method of assembling a shield to a multi-port connector which involves the step of securing the shield to both the front and rear of the connector housing.

It is a still further objective of the invention to provide a method of assembling a shield to an RJ connector in which the shield is secured to the connector housing after placement of the shield in position on the housing and upon folding of the rear panel of the shield into place at the rear of the connector housing, and in which the shield is secured to the housing at the front and rear of the connector housing.

Finally, it is also an objective of the invention to provide a shielded multi-port RJ connector that includes two indicator lights for each port.

These objectives are accomplished, in accordance with a preferred embodiment of the invention, by providing the connector with a stamped and formed shield having a top panel for covering a top wall of a housing of the connector, side panels for covering the opposite sides of the housing, a front panel for covering a front of the housing about a plug opening, and a rear panel for covering a rear of the housing, the bottom of the front panel including a transverse extension which fits under the front portion of the connector housing after fitting of the shield on the housing and before securing the shield to the housing, and the rear panel of the shield including a forwardly extending tab supporting an upwardly extending latch, the latch cooperating with a cavity on the lower side of the connector to secure the shield to the connector when the rear panel of the shield is folded over the rear of the connector to complete assembly of the shield to the connector.

In an especially preferred embodiment of the invention, the connector is a multi-port connector and the shield includes an inwardly extending front shelf and a plurality of complementary latches and cavities distributed over the length of the connector.

Finally, the preferred embodiments of the invention may also include a plurality of indicator lights assembled in accordance with the principles disclosed in copending U.S. patent application Ser. No. 08/422,865, filed on Apr. 17, 1995, with two indicator lights being provided for each port.

DETAILED DESCRIPTION OF THE PREFERRED EMBODIMENTS

Figure 1:
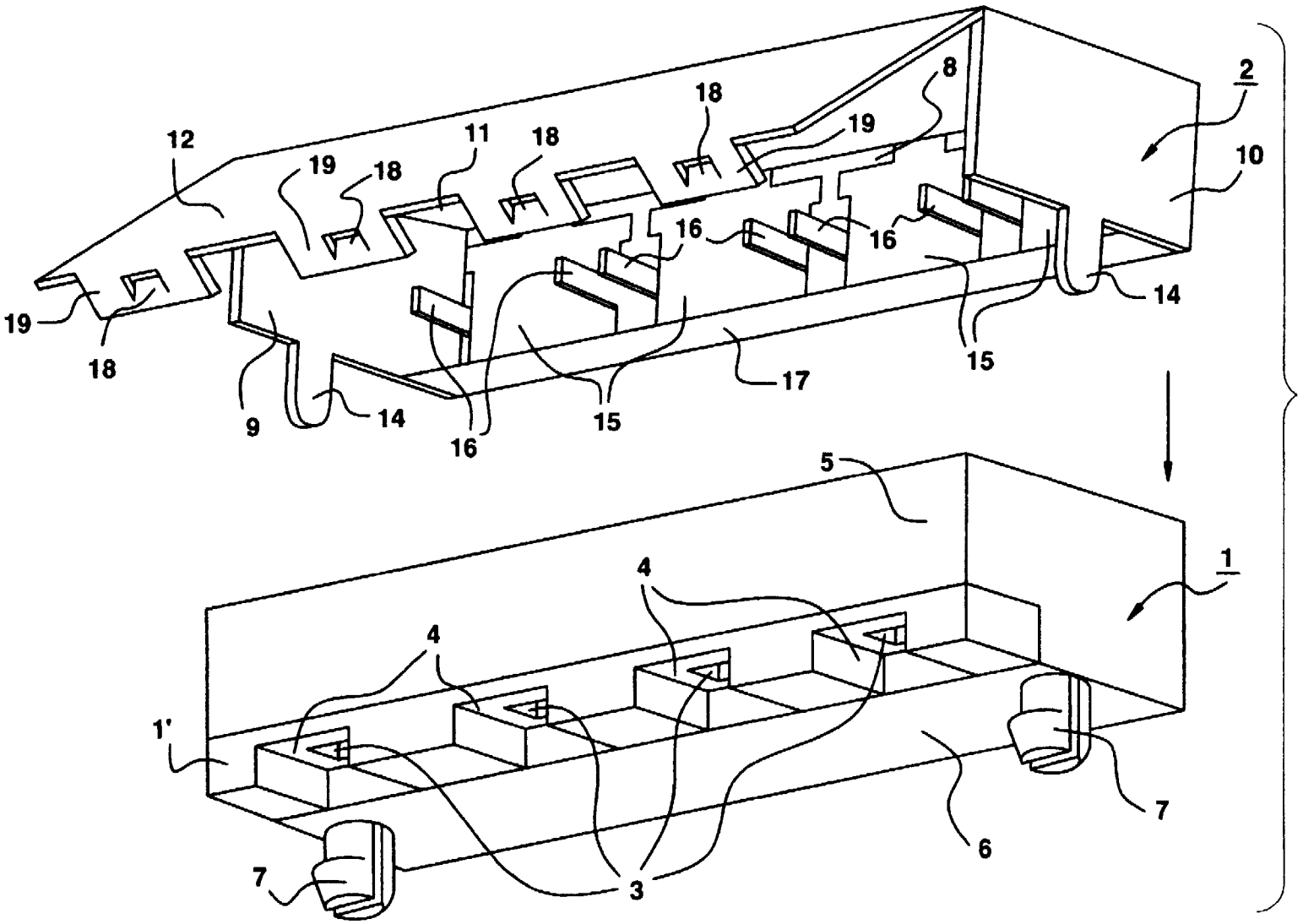
FIG. 1 is a perspective view of a first preferred embodiment of the invention.
Figure 2:
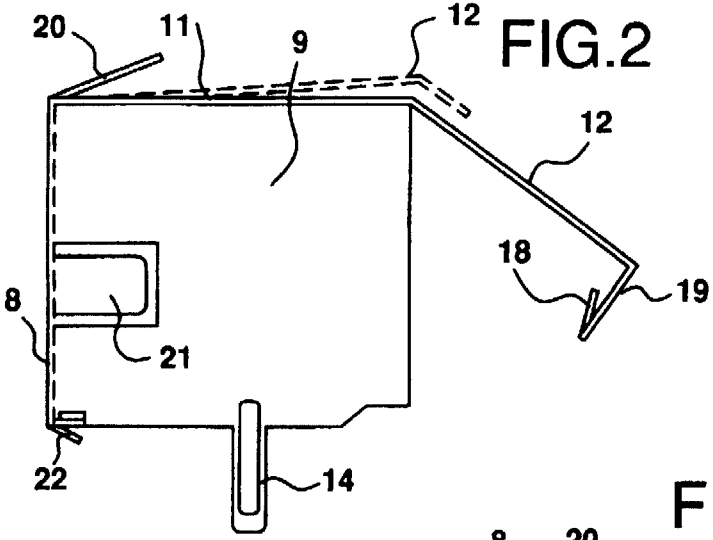
FIG. 2 is a side view of an RJ connector shield constructed in accordance with the principles of the preferred embodiment of the invention.
Figure 3:
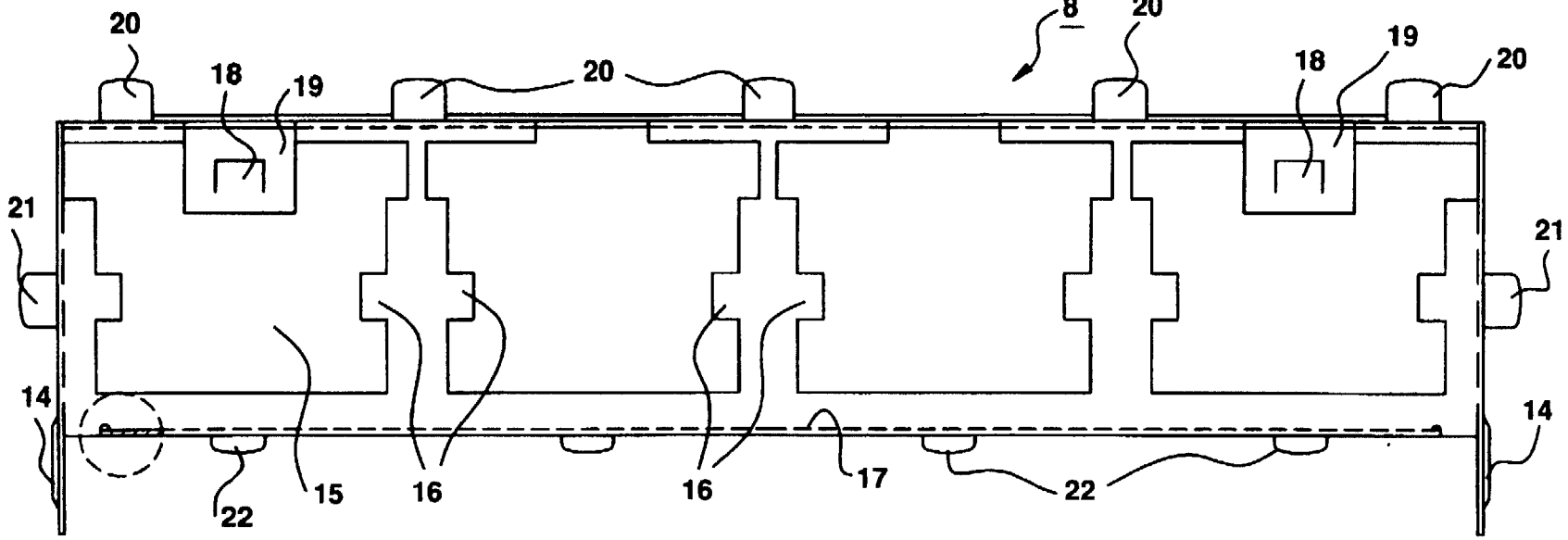
FIG. 3 is a front view of the shield of FIG. 2.

FIG. 1 illustrates the basic principles of the invention. The multi-port connector illustrated in FIG. 1 includes a molded plastic housing 1 and a shield 2. Molded plastic housing 1, a rear lower portion 1' of which may be separately formed, includes a plurality of ports or receptacle openings (not shown in this view), each accommodating a plurality of contacts (also not shown in this view), with each port having at the rear a snap cavity 3 situated in a recess 4 extending from the rear wall 5 and bottom wall 6 of the connector. Also shown in this view are a pair of mounting posts 7 for mounting the connector on a circuit board.

According to the principles of the invention, the shield is in the form of a stamped and formed member which, prior to assembly to the connector, has been folded to form a parallelpiped-shaped structure made up of a front panel 8, side panels 9 and 10, a top panel 11, and a rear panel 12, the rear panel being left parallel to the top panel. Extending from side panels 9 and 10 are respective grounding tabs 14 for insertion into apertures in the circuit board, and extending from the front panel, adjacent openings 15 are grounding tabs 16 for engaging shields on the plug connectors to be inserted into the plug receptacles.

It will be appreciated by those skilled in the art that each of the shield structures 8–16 are conventional and, on the other hand, that these structures may be varied to meet the requirements of the application in which the connector is used.

Figure 4:
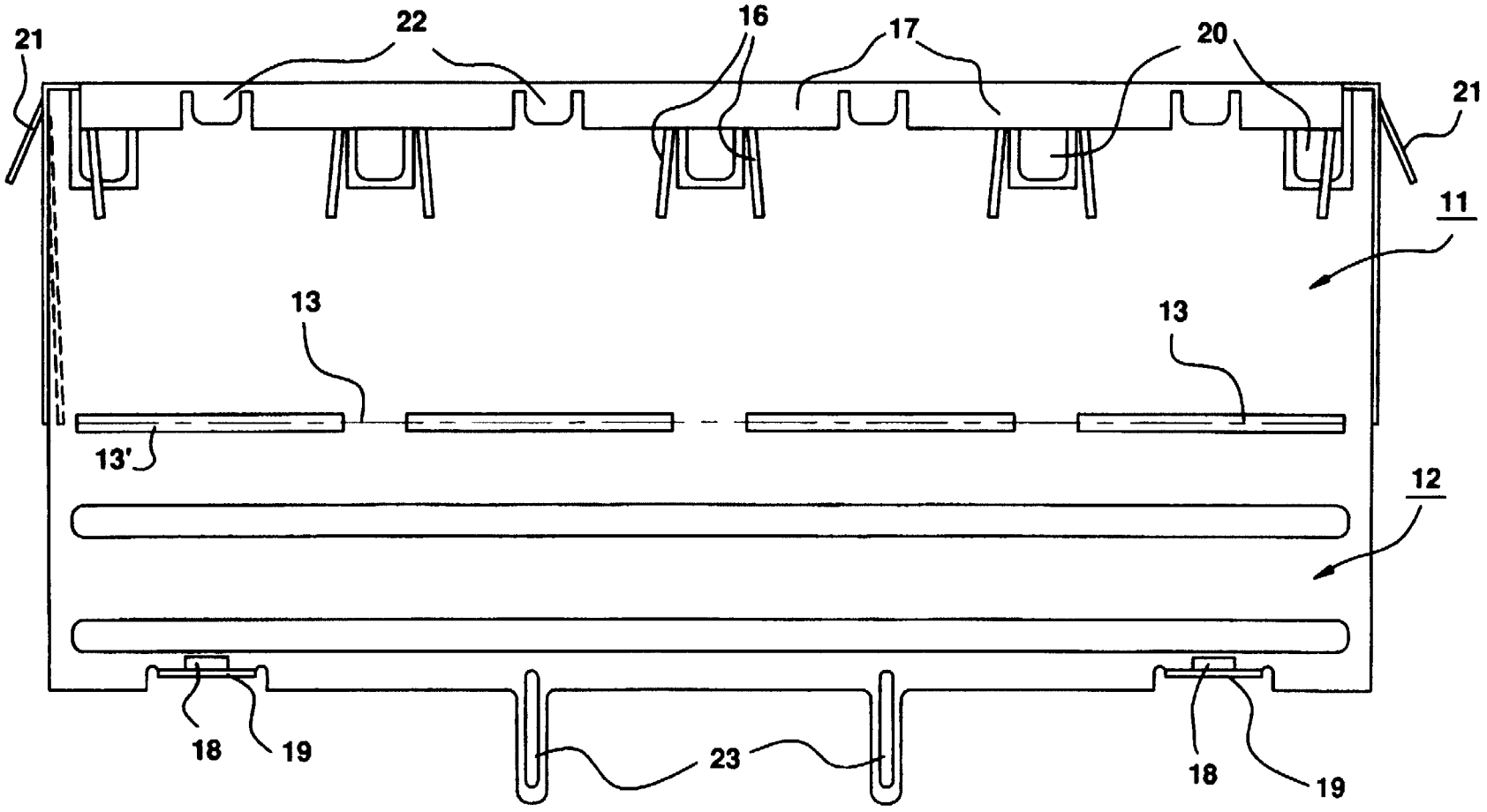
FIG. 4 is a plan view, taken from below, of the shield of FIG. 2, before assembly to the connector.
Figure 5:
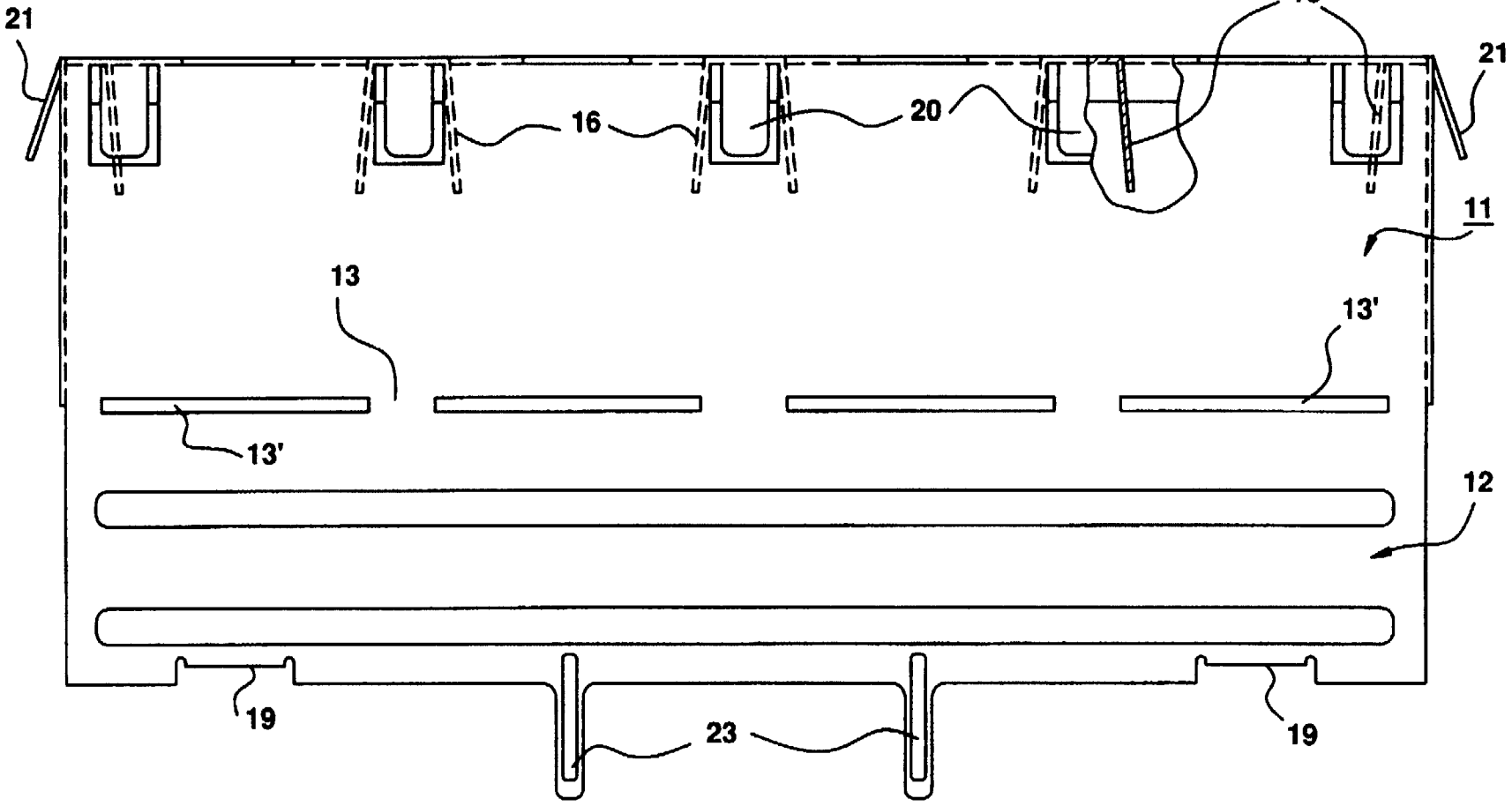
FIG. 5 is a plan view, taken from above, of the shield of FIG. 2, before assembly to the connector.
Figure 6:
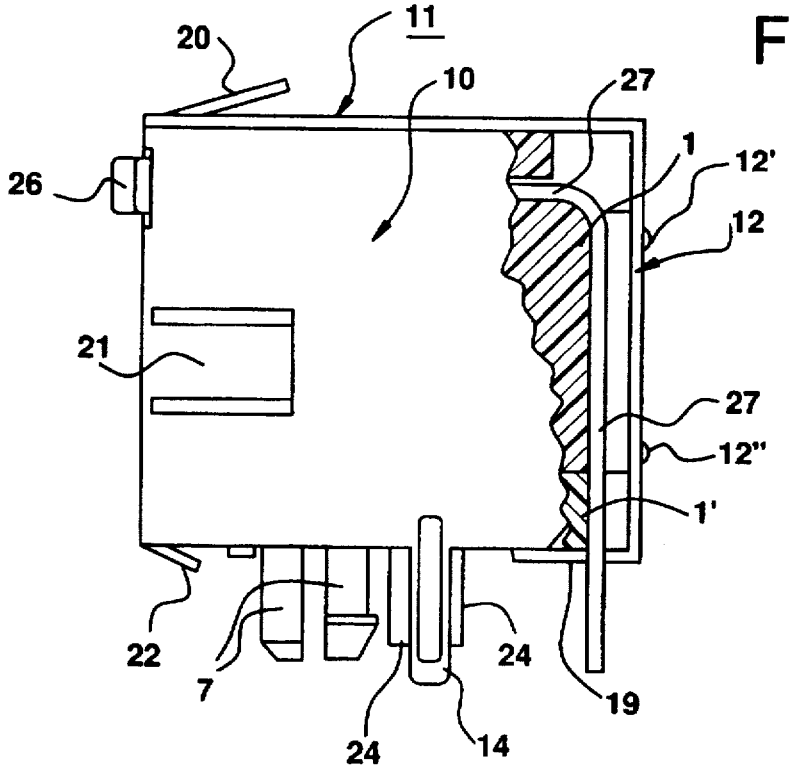
FIG. 6 is a partially cross-sectional side view of a multi-port RJ connector to which the shield of FIG. 2 has been assembled.
Figure 7:
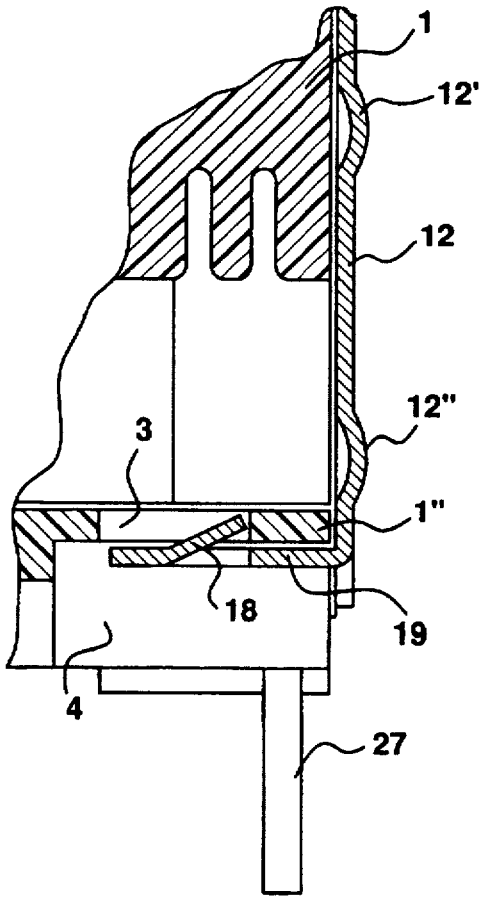
FIG. 7 is an enlarged cross-sectional side view of the connector of FIG. 6.
Figure 8:
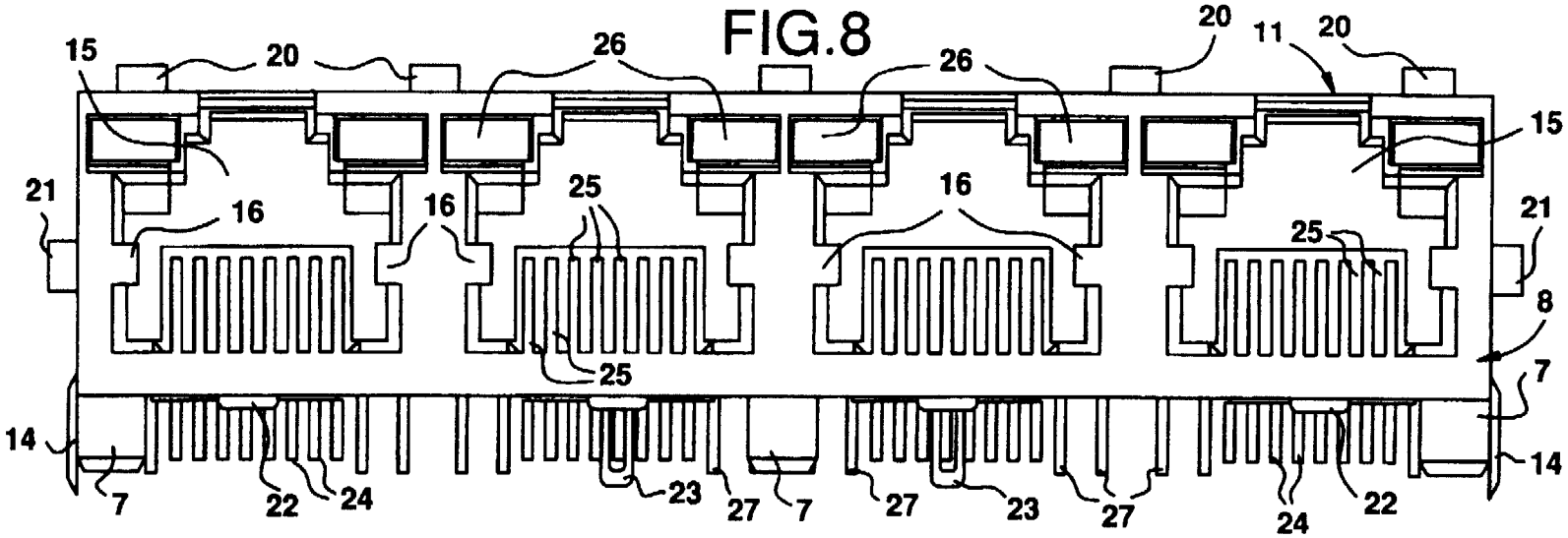
FIG. 8 is a front view of the connector of FIG. 6.
Figure 9:
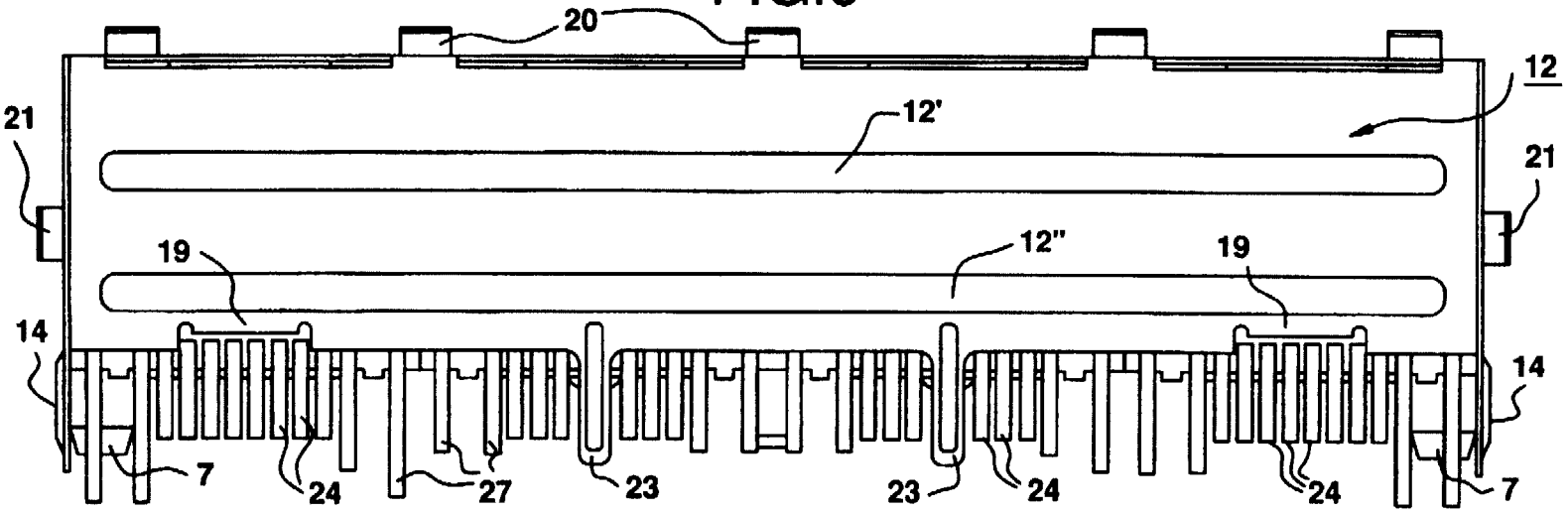
FIG. 9 is a rear view of the connector of FIG. 6.
Figure 10:
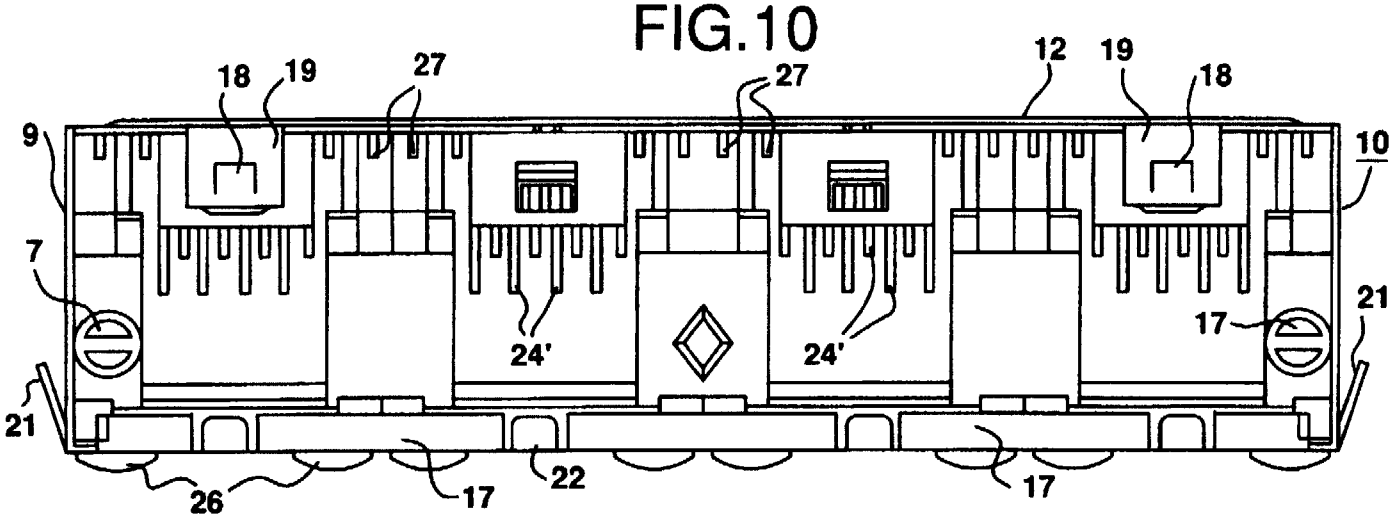
FIG. 10 is a bottom view of the connector of FIG. 6.
Figure 11:
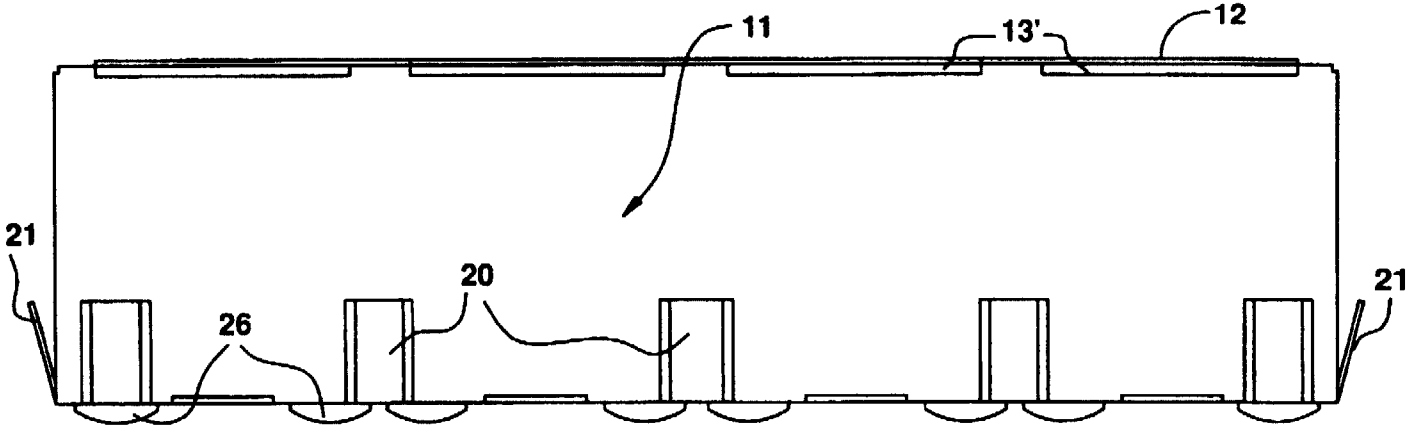
FIG. 11 is a top view of the connector of FIG. 6.

Extending rearwardly from the front panel of the shield is a retention shelf 17 which fits under the front portion of the housing and extend across the width of the shield. Shelf 17 cooperates with snap latches 18 on tabs 19 which extend forwardly from the rear panel of the shield to retain the shield on the housing. Snap latches 18 are in the form of tabs angled upwards and rearwardly relative to the tabs 19 such that when the rear panel is folded along line 13 into position against the rear wall of the housing after the shield has been fitted over the housing, latches 18 are initially bent downwards flush with the tabs to pass over the surface of the recess 4 and then, because of the restoring force on the tabs, snap into snap cavities 3 to retain the shield on the housing. Optionally, folding of the rear panel may be facilitated by including cut-outs 13' along fold-line 13, as illustrated in FIGS. 4 and 5, which show the shield before folding.

It will be appreciated by those skilled in the art that the illustrated details of the interengaging means on the rear panel of the shield and the lower surface adjacent the rear edge of the connector housing may be varied in a number of ways, including placing a detent on the housing and a cooperating aperture on the tab, and the terms "latching" or "securing" means are not to be limited to a particular latch structure, but rather should be interpreted as encompassing any structure for latching the rear panel of the shield to a lower surface of the connector housing adjacent the rear wall of the connector.

As shown in greater detail in FIGS. 2–5, the shield may also include upper grounding tabs 20, depending on the location of the panel member to which the shield is grounded, side grounding tabs 21, and/or lower grounding tabs 22 (cut out of shelf 17), as well as rear panel grounding extensions 23 for insertion into the circuit board on which the connector is mounted. It will be noted that in this embodiment of the invention, only two latching means made up of tabs 19 and latches 18 are provided, the number of latches of course being variable.

Turning to FIGS. 6–10, which show an assembled connector including the shield of FIGS. 2–5, the four ports of the multi-port connector contain eight contacts each, as is standard for the type of connector known as the RJ-45 connector, with the contacts including vertical legs 24 for insertion into the circuit board, forwardly extending sections 24', and oblique sections 25 extending into the plug receiving cavities for engaging corresponding contacts on the plug connector. It will of course be appreciated by those skilled in the art that the contacts could also be arranged to extend from the top, rather than the bottom, of the plug receiving openings 15.

Finally, in the preferred embodiment of the invention, associated with each of the ports are a pair of indicator lights in the form of light emitting diodes 26 arranged to fit into cavities extending rearwardly from the front of the connector, the cavities communicating with recesses through which extend, rearwardly and downwardly as illustrated, leads 27 for connection to the circuit board in the manner described in copending U.S. patent application Ser. No. 08/422,865.

By providing the rear panel 12 with means 18.3 for securing the rear panel to the lower surface 6 of the housing, and by also providing an inward extension or shelf 17 from the front panel 8 of the shield, assembly of the preferred shield to the housing is greatly simplified. Essentially, the method of assembling the shield to the housing involves the steps of fitting the shield 2 over the housing 1 of the connector such that the shield covers a front wall, side walls, a top wall, and a front portion of a lower surface of the connector housing, but is not otherwise secured to the housing, and securing the shield to the housing folding a rear panel 12 of the shield over a rear wall of the housing and at the same time causing the rear panel of the shield to be latched to the housing by engagement between latch 18 and cavity 3. In the case of a multi-port connector, a plurality of latches 18 are distributed along the width of the rear panel of the shield and a corresponding plurality of cavities 3 are provided in the lower surface of the housing adjacent the rear wall of the housing and snapped simultaneously into place upon folding of the rear panel about fold-line 13.

Having thus described various preferred embodiments of the invention, those skilled in the art will appreciate that variations and modifications of the preferred embodiment may be made without departing from the scope of the invention. It is accordingly intended that the invention not be limited by the above description or accompanying drawings, but that it be defined solely in accordance with the appended claims.

We claim:

1. A shielded electrical connector having an insulative housing, said housing including a bottom wall, a top wall, a rear wall, a front wall, and side walls extending between said top and bottom walls and also between said front and rear walls, said shielded electrical connector further including a one-piece metal shield of the type in which a rear panel of the shield is in a first position while the shield is being fitted over the housing, said rear panel in said first position being substantially coplanar with a top panel of the shield and said shield having in addition to the rear panel and said top panel, side panels for engaging the side walls of the housing; a front panel having openings for permitting passage of a mating connector, and a transverse extension of the front panel for engaging the bottom wall of the housing adjacent the front wall of the housing; and wherein said shield further comprises:

means for permitting the rear panel to be folded from said first position in which the rear panel is substantially coplanar with the top panel to a second position in which the rear panel is substantially perpendicular to said top panel to cover the rear wall of the connector housing after the shield has been fitted over the housing, wherein said bottom wall of the housing and the rear panel of the shield have formed therein respective complementary latching means for securing the rear panel of the shield to the bottom wall of the housing at a location on the bottom wall which is adjacent the rear wall of the housing, said latching means and said extension of the front wall of the housing cooperating to retain the shield on the housing, and wherein said latching means comprises a tab extending transversely from the rear panel of the housing, a latch extending upwardly from said tab, and a cavity in said bottom wall adjacent the rear wall of the housing for receiving said latch.

2. A connector as claimed in claim 1, wherein said housing includes a plurality of openings, each of which includes electrical contacts arranged to engage electrical contacts of a mating connector, and said front panel of the shield includes an opening corresponding to each of the housing openings.

3. A connector as claimed in claim 2, wherein said electrical contacts in said housing openings are RJ contacts.

4. A connector as claimed in claim 2, wherein said front panel further includes grounding tabs extending rearwardly from edges of said front panel openings for engaging shields on mating connectors.

5. A connector as claimed in claim 2, wherein said front panel further includes grounding tabs extending rearwardly from a top edge of the shield.

6. A connector as claimed in claim 2, wherein said front panel further includes a grounding tab extending rearwardly and outwardly from side edge of the front panel.

7. A connector as claimed in claim 2, wherein said complementary latching means include a plurality of said latches and said cavities spaced along said lower edges of the rear panel and rear wall of the connector.

8. A connector as claimed in claim 7, further comprising recesses in said bottom wall adjacent the rear of the housing for receiving said tabs to ensure that said tabs are flush with the bottom wall of the housing.

9. A connector as claimed in claim 1, further comprising recesses in said bottom wall adjacent the rear of the housing for receiving said tabs to ensure that said tabs are flush with the bottom wall of the housing.

10. A connector as claimed in claim 1, further comprising a plurality of indicator lights fitted into recesses in the front wall of the housing on each of two sides of each of said openings, said recesses communicating with passages through which leads of the indicator lights pass to engage a circuit board on which the connector is mounted.

11. A connector as claimed in claim 1, wherein said housing includes an opening which includes electrical contacts arranged to engage electrical contacts of a mating connector.

12. A connector as claimed in claim 11, wherein said electrical contacts in said housing opening are RJ contacts.

13. A connector as claimed in claim 11, wherein said front panel further includes grounding tabs extending rearwardly from edges of said front panel opening for engaging a shields on a mating connector.

14. A connector as claimed in claim 11, wherein said front panel further includes grounding tabs extending rearwardly from a top edge of the shield.

15. A connector as claimed in claim 11, wherein said front panel further includes a grounding tab extending rearwardly and outwardly from side edge of the front panel.

16. A connector as claimed in claim 11, wherein said complementary latching means include a plurality of said latches and said cavities spaced along said lower edges of the rear panel and rear wall of the connector.

17. A one-piece metal shield for an electrical connector of the type having an insulative housing, said housing including a bottom wall, a top wall, a rear wall, a front wall, and side walls extending between said top and bottom walls and also between said front and rear walls, wherein a rear panel of the shield is in a first position while the shield is being fitted over the housing, said rear panel in said first position being substantially coplanar with a top panel of the shield and said shield having in addition to the rear panel and said top panel, side panels for engaging the side walls of the housing, a front panel having openings for permitting passage of a mating connector, and a transverse extension of the front panel for engaging the bottom surface of the housing adjacent the front wall of the housing; and further comprising means for permitting the rear panel to be folded from said first position in which the rear panel is substantially coplanar with the top panel to a second position in which the rear panel is substantially perpendicular to said top panel to cover the rear wall of the connector housing after the shield has been fitted over the housing, wherein said side wall of the housing and the rear panel of the shield have formed therein respective complementary latching means for securing the rear panel of the shield to the bottom wall of the housing at a location on the side wall which is adjacent the rear wall of the housing, said latching means and said extension of the front wall of the housing cooperating to retain the shield on the housing, and wherein said latching means comprises a tab extending transversely from the rear panel of the shield, a latch extending upwardly from said tab, and a cavity in said bottom wall adjacent the rear wall of the housing for receiving said latch.

18. A shield as claimed in claim 17, wherein said shield is shaped to fit an multiple port housing including a plurality of openings, each of which includes electrical contacts arranged to engage electrical contacts of a mating connector, and said front panel of the shield includes an opening corresponding to each of the housing openings.

19. A shield as claimed in claim 18, wherein said shield is shaped to fit a multiple port RJ connector housing.

20. A shield as claimed in claim 18, wherein said front panel further includes grounding tabs extending rearwardly from edges of said front panel openings for engaging shields on mating connectors.

21. A shield as claimed in claim 18, wherein said front panel further includes grounding tabs extending rearwardly from a top edge of the shield.

22. A shield as claimed in claim 18, wherein said front panel further includes a grounding tab extending rearwardly and outwardly from side edge of the front panel.

23. A shield as claimed in claim 18, wherein said complementary latching means include a plurality of said latches spaced along said lower edges of the rear panel.

24. A shield as claimed in claim 17, further comprising recesses in said bottom wall adjacent the rear of the housing for receiving said tabs to ensure that said tabs are flush with the bottom wall of the housing.

25. A shield as claimed in claim 17, wherein said housing includes an opening which includes electrical contacts arranged to engage electrical contacts of a mating connector.

26. A shield as claimed in claim 17, wherein said electrical contacts in said housing opening are RJ contacts.

27. A shield as claimed in claim 17, wherein said front panel further includes grounding tabs extending rearwardly from edges of said front panel opening for engaging a shields on a mating connector.

28. A shield as claimed in claim 17, wherein said front panel further includes grounding tabs extending rearwardly from a top edge of the shield.

29. A shield as claimed in claim 17, wherein said front panel further includes a grounding tab extending rearwardly and outwardly from side edge of the front panel.

30. A shield as claimed in claim 17, wherein said complementary latching means include a plurality of said latches and said cavities spaced along said lower edges of the rear panel and rear wall of the connector.

31. A method of assembling a metal shield to an electrical connector, comprising the steps of:

(a) fitting the shield over an insulative housing of the connector such that said shield covers a front wall, side walls, a top wall, and a front portion of a bottom wall of the connector housing but is not otherwise secured to the housing, and (b) securing the shield to the housing by folding a rear panel of the shield over a rear wall of the housing and at the same time causing said rear panel of the shield to be latched to the housing, wherein step (b) comprises the step of causing a latch situated on a tab extending forwardly from the rear panel of the shield to enter a cavity in the bottom wall of the housing adjacent the rear wall of the housing.

32. A method as claimed in claim 31, wherein the housing is a multi-port housing and step (b) comprises the step of causing a plurality of latches situated on a respective plurality of tabs extending forwardly from the rear panel of the shield to enter a respective plurality of cavities in the bottom wall of the housing adjacent the rear wall of the housing and distributed across a width of the housing.

* * * * *